United States Patent [19]

Hasegawa

[11] 4,165,015

[45] Aug. 21, 1979

[54] LANCED SCORED AND PUNCHED EASY OPENING PANEL ARRANGEMENTS

[75] Inventor: Gary K. Hasegawa, Chicago, Ill.

[73] Assignee: The Continental Group, Inc., New York, N.Y.

[21] Appl. No.: 944,955

[22] Filed: Sep. 22, 1978

[51] Int. Cl.[2] ..... B65D 41/32

[52] U.S. Cl. ..... 220/269; 220/270; 220/359; 220/258

[58] Field of Search ..... 220/260, 266–271, 220/359, 258; 229/7 R; 222/541

[56] References Cited

U.S. PATENT DOCUMENTS

| | | | |
|---|---|---|---|
| 3,883,034 | 5/1975 | Rausing | 220/359 X |
| 3,977,562 | 8/1976 | Wedzik | 220/359 X |
| 4,108,330 | 8/1978 | Patterson | 220/269 X |

*Primary Examiner*—George T. Hall
*Attorney, Agent, or Firm*—Charles E. Brown

[57] ABSTRACT

Easy opening configurations for forming in a container panel a dispensing opening. Each easy opening configuration is generally defined by one cut line and one or more score lines. A pull tape overlies the easy opening configuration and has a terminal end permanently bonded to the container panel. The pull tape also has a permanent bond with a removable panel portion defined by the cut and score lines as well as a peelable bond with the container panel surrounding the removable panel portion. If desired, apertures may be formed at the ends of the cut line to prevent initiation of rupture along the score lines. Also, if desired, force reducing openings may be formed in the removable panel portions.

25 Claims, 7 Drawing Figures

LANCED SCORED AND PUNCHED EASY OPENING PANEL ARRANGEMENTS

This invention relates in general to new and useful improvements in container constructions, and more particularly to containers having an easy opening panel arrangement.

It is conventional to provide easy opening containers wherein either preformed openings are formed in a panel or a removable panel portion is defined by either a cut line or a score and wherein a pull tape overlies such openings or removable panel portions to effect the opening of the container by merely pulling on the tape. This invention relates to improvements in this type of easy opening container.

First of all, it is proposed to form an easy opening container, particularly an end panel of an end unit, with means for forming a dispensing opening wherein a removable panel portion is defined by a starting cut line and one or more score lines extending from the opposite ends of the cut line. A pull tape overlies the end panel and has a portion thereof permanently bonded to the removable panel portion and a spaced portion permanently bonded to the end panel so that the removable panel portion remains attached to the end panel after the opening of the container. Further, the pull tape is provided with a peelable bond with the end panel surrounding the removable panel portion so as to maintain a seal.

Preferably with the above easy opening construction the cut line defines the widest or at least a wider portion of the resultant dispensing opening and is disposed adjacent the periphery of the end panel so as to facilitate pouring of the product through the dispensing opening with the inner end portion of the dispensing opening functioning as a vent.

Another feature of the invention is the formation of apertures at the opposite ends of the cut line so that there is no tendency for the initiation of the rupture of the end panel along the score line or lines.

Another feature of the invention is the formation of the score line as a single continuous line of a generally U-shaped configuration wherein the removable panel portion may be completely separated from the container panel except for the permanent connection between the pull tape and the container panel.

In another form of the invention, in lieu of there being a single score line there are two score lines terminating in connecting strap defining portions whereby in addition to the permanent bond between the pull tape and the container panel retaining the removable panel portion assembled with the container, the connecting strap also performs that function.

It has been found that when the container panel is weakened by the formation of cut or score lines therein, there is a possibility of premature rupture due to the relatively high forces applied against the removable panel portion by the internal pressure within the container. It has been found that this tendency of premature rupture may be greatly reduced and in most instances eliminated by the simple formation of openings in the removable panel portion so that the pressure affected area of the removable panel portion is reduced with the pull tape serving to absorb a portion of the heretofore pressure force applied against the removable panel portion. The opening or openings may assume beneficial patterns.

With the above and other objects in view that will hereinafter appear, the nature of the invention will be more clearly understood by reference to the following detailed description, the appended claims and the several views illustrated in the accompanying drawings.

Figure 1:
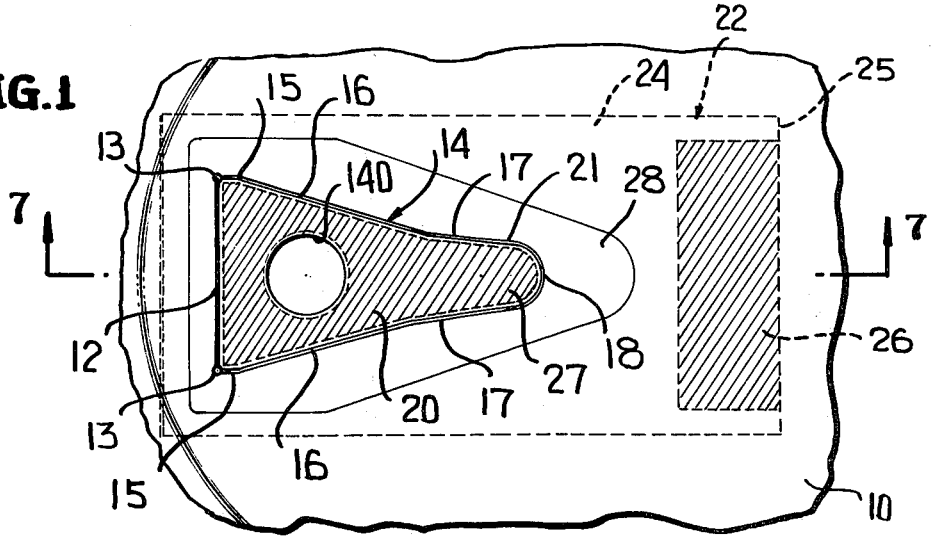
FIG. 1 is a schematic plan view of a container panel having formed thereon a dispensing opening defining a removable panel portion and there being illustrated the bonds between the pull tape and various portions of the container panel, the outline of the pull tape having been shown in phantom lines.
Figure 7:
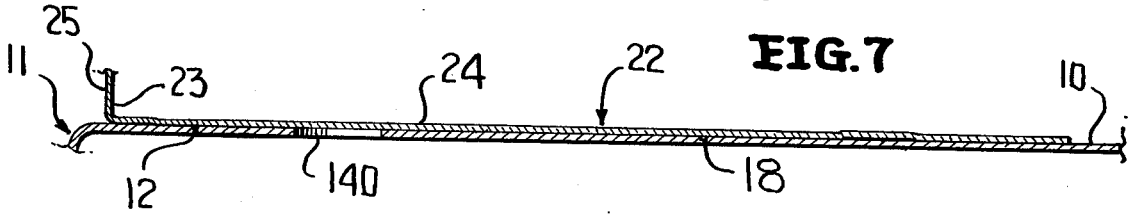
FIG. 7 is a typical cross sectional view taken generally along the line 7—7 of FIG. 1.

Referring now to the drawings in detail, reference is first made to FIGS. 1 and 7 wherein there is illustrated a typical container panel, generally identified by the numeral 10. In the illustrated example, the container panel 10 is an end panel of a container end unit generally identified by the numeral 11. In order to effect the dispensing of the product within a container closed by the end unit 11, it is desirable to provide means for the formation of a dispensing opening without the use of any tools, such as openers and the like. Accordingly, a desired opening configuration is defined by a combination of cut and score lines.

Most particularly, as is clearly illustrated in FIG. 1, the end panel 10 is provided with a cut line 12 which terminates at its opposite ends in small diameter through apertures 13. The desired configuration of the dispensing opening is otherwise defined by a continuous, generally U-shaped score line 14 which defines a line of weakness along which the end panel 10 may be ruptured under certain conditions. The score line 14 has adjacent each aperture 13 a longitudinally extending portion 15 which terminates in a longitudinally and transversely sloping portion 16 which, in turn, terminates in a longitudinally and transversely sloping portion 17 which has a lesser transverse slope than the portion 16. The portions 17 are interconnected by an arcuate portion 18. It is to be understood that the cut line 12 together with the apertures 13 and the score line 14 define a removable panel portion 20 which may be removed out of the plane of the end panel 10 in its entirety. The removable panel portion 20, when removed from the end panel 10, defines a dispensing opening 21.

With further reference to the cut and score lines 12, 14, it is to be noted that the cut line 12 extends transversely of the generally longitudinal extent of the removable panel portion 20 and is at the widest portion of the removable panel portion. Further, it is to be noted that it is disposed adjacent the periphery of the end panel 10 so as to form the bottom edge of the dispensing opening 21 when the associated container is in a tilted dispensing position. It is further to be noted that the parts of the score line portions 17 adjacent the score line 18 together with the score line portion 18 will define a vent opening portion of the dispensing opening 21.

Opening of the end unit 11 is effected by means of a conventional type of pull tape, generally identified by the numeral 22. The pull tape is formed from an elongated generally rectangular strap which has an end portion 23 extending at an angle to a main portion 24 and wherein the end portion 23 has a finger receiving opening 25 so that the portion 23 may function as a grip portion. The portion 24, which is shown in dotted lines in FIG. 1, is also of an elongated rectangular configuration and is bonded to various portions of the end panel 10 in varying manners. At this time it is pointed out that the pull tape 22 may be selectively formed of metal foil, plastic film or a lamination thereof.

First of all, the pull tape portion 24 has a terminal end 25 disposed remote from the portion 23. This terminal end is spaced from the removable panel portion 20 and is permanently bonded to the end panel 10 by a permanent bond 26 which is illustrated as being rectangular in outline and being elongated transversely of the pull tape.

A second permanent bond 27 is formed between the pull tape 22 and the removable panel portion 20. It is to be noted that the permanent bond 27 is over an area corresponding in outline to the outline of the removable panel portion 20.

Finally, there is a third bond between the pull tape 22 and the container or end panel 10, this third bond being identified by the numeral 28 and being a peelable bond, although it is of sufficient strength to resist the accidental opening of the end unit 11. The peelable bond 28 surrounds the removable panel portion 20 and is of a general outline corresponding to the outline of the removable panel portion 20.

It is to be understood that although the end panel 10 has lost its integrity due to the formation of the cut line 12 and the apertures 13 wherein under normal conditions pressure within an associated container to be vented the peelable bond 28 between the end panel 10 and the pull tape 22 is sufficient to resist peeling due to any force exerted on the pull tape through the openings defined by the cut line 12 and the apertures 13. Further, the pull tape 22 exerts a hold down force on the removable panel portion 20 sufficient to prevent accidental rupture of the score line 14.

When it is desired to open the end unit 11, the grip portion of the pull tape 22 is engaged and lifted upwardly and to the right as viewed in FIGS. 1 and 7. Without excessive pulling force being required, the peelable bond 28 may be progressively ruptured until the cut line 12 and the apertures 13 are uncovered, at which time the interior of the associated container will be vented. As the pull tape is continued to be removed upwardly and to the right, due to the permanent bond 27 between the removable panel portion 20 and the pull tape 22, the end panel 10 will be progressively ruptured along the remote halves of the score line 14 with the result that the removable panel portion 20 will be gradually torn away from the end panel and the dispensing opening 21 will be formed.

A continued movement of the pull tape to the right will result in the complete peeling or rupture of the peelable bond 28 until such time as the pull tape 22 is firmly retained by the permanent bond 26. At this time the pull tape 22 and the attached removable panel portion 20 may be folded to an out of the way position, thereby providing free access to the dispensing opening 21.

It is to be understood that the permanent bonds 26 and 27 and the peelable bond 28 will be formed in any conventional manner and the strengths of the different bonds may be effected by the utilization of different adhesives as an example only.

Figure 2:
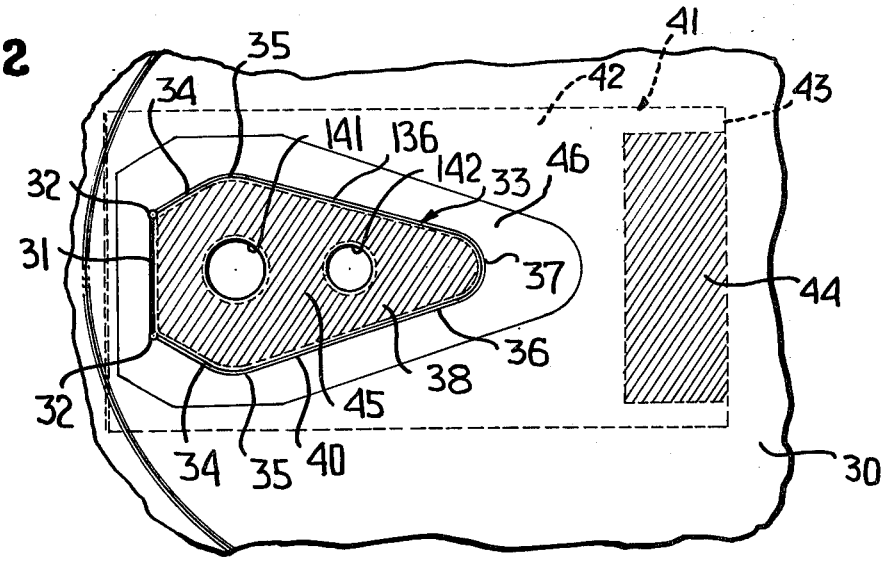
FIG. 2 is a schematic plan view similar to FIG. 1, showing a modified form of removable panel portion and bond arrangement.

Reference is now made to FIG. 2, wherein a modified form of dispensing opening is provided. As in the case of FIG. 1, there is illustrated a container panel 20 which may be in the form of an end panel and is part of an end unit, such as the end unit 11. The end panel 30 has formed therein as part of the dispensing opening forming configuration a cut line 31 which extends between a pair of apertures 32. Extending from the apertures 32 are opposite ends of a generally U-shaped score line 33 which defines a line of weakness. The score line 33 has extending from each aperture 32 a longitudinally and transversely sloping portion 34 to which there is joined by means of an arcuate intermediate portion 35 a longitudinally and transversely sloping portion 36. The ends of the portions 36 remote from the cut line 31 are joined by an arcuate portion 37. The cut line 31, apertures 32 and score line 33 in combination define a removable panel portion 38 which, when removed, forms in the end panel 30 a dispensing opening 40.

The end unit is also provided with a pull tape 41 which is identical to the pull tape 22 and of which only that portion which directly overlies the end panel 30 is illustrated, the pull tape portion being identified by the numeral 42. The pull tape portion 42 has a free edge 43 disposed remote from the cut line 31, and immediately adjacent the edge 43 the pull tape 41 is permanently bonded to the end panel 30 by a permanent bond 44 which is generally rectangular in outline. The pull tape 41 is also permanently bonded to the removable panel portion 38 by a permanent bond 45.

A peelable bond 46 is formed between the pull tape 41 and the end panel 30 surrounding the removable panel portion 38. Inasmuch as the function of the pull tape 41 is the same as that of the function of the pull tape 22, no further description of the function of the pull tape 41 is required, except to understand that it does seal the end unit 30 with respect to the cut line 31 and the apertures 32 and when pulled, pulls with it the removable panel portion 38 so as to open the end unit and define the dispensing opening 40.

Figure 3:
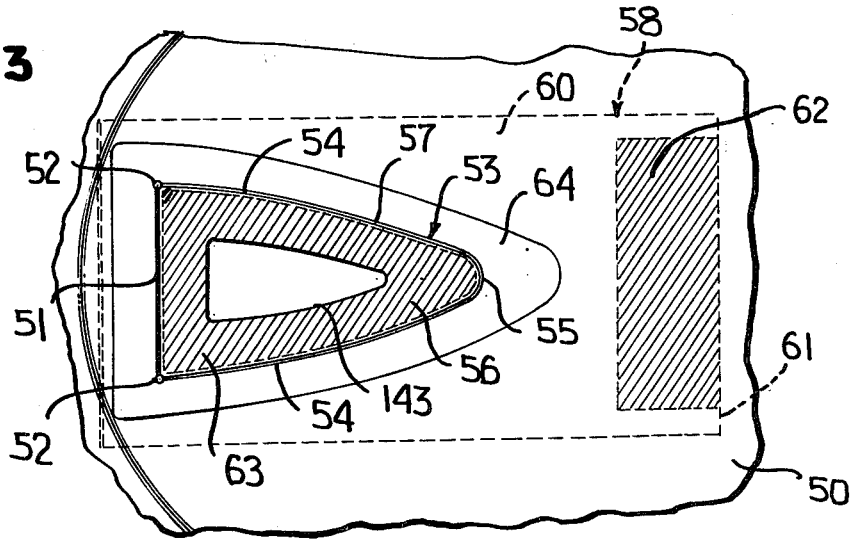
FIG. 3 is another schematic plan view, showing a further modified form of removable panel portion and bond arrangement.

In FIG. 3 there is illustrated yet another form of easy opening container construction which includes a container panel 50 which normally will be in the form of an end panel of an end unit such as the end unit 11. The container panel 50 is provided with a combination of cut and score lines to define a dispensing opening when a removable panel portion defined by the cut and score lines is removed from the end panel 50.

The cut and score lines include a transversely extending cut line 51 which terminates at its opposite ends in apertures 52. A single generally U-shaped score line 53 has the free ends thereof teminating in the apertures 52. It is to be noted that the score line 53 includes slightly arcuate longitudinally extending and transversely sloping portions 54 beginning at each aperture 52 and extending away from the cut line 51. The portions 54 are joined by an arcuate portion 55.

The cut line 51, the apertures 52 and the score line 53 combine to define a generally triangular removable panel portion 56 which, when removed, defines a dispensing opening 57 in the end panel 50. The cut line 51 defines the widest portion of the dispensing opening 57 and is positioned adjacent the periphery of the end panel 50 so that the inner portion of the dispensing opening 57 will function as a vent opening. It is to be understood that the dispensing through the dispensing opening 57 will be the same as that described with respect to FIG. 1 and, of course, the same as that which is effective with the embodiment of FIG. 2.

The removable panel portion 56 is covered by a pull tape 58 which will be of an identical construction to the pull tapes 22 and 41 and of which only a portion 60 is schematically illustrated. The pull tape portion 60 includes a terminal end 61 disposed remote from the cut line 51. A terminal end portion of the pull tape 58 is secured to the end panel 50 by a permanent bond 62 which is rectangular in outline.

The pull tape 58 is also secured to the removable panel portion 56 by a permanent bond 63 of an outline substantially corresponding to the outline of the removable panel portion. The pull tape 58 is further bonded to the end panel 50 by means of a peelable bond 64 which corresponds generally to the peelable bond 28 of FIG. 1.

It is to be understood that the peelable bond 64 has sufficient strength to prevent venting of the container through the score line 51 and the apertures 52 and also to resist accidental rupture of the score line 53. On the other hand, the peelable bond 64 may be readily peeled from the end unit 50 when the pull tape 58 is pulled upwardly and to the right. On the other hand, the permanent bond 63 is of sufficient strength to effect the rupture of the score line 53 and the removal of the removable panel portion 56 with the pull tape.

Figure 4:
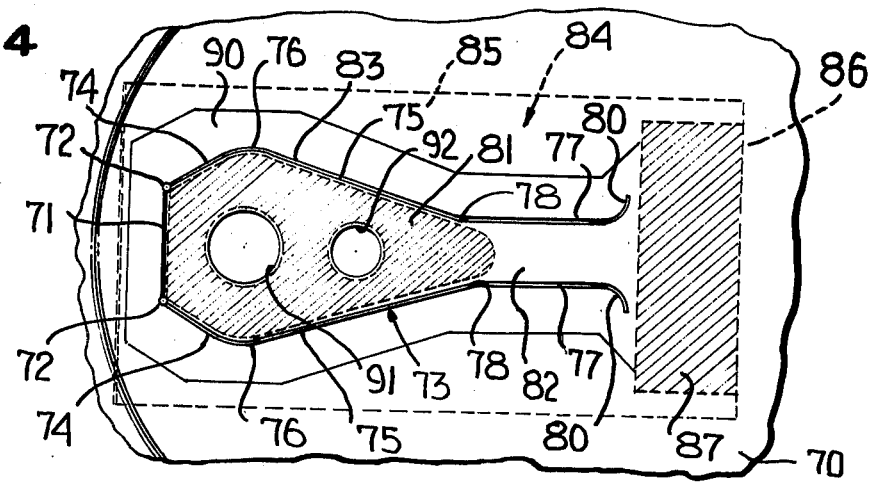
FIG. 4 is a schematic plan view similar to FIG. 1, showing yet another modified form of removable panel portion but wherein the removable panel portion has a permanent connecting strap secured to the container panel.

In FIG. 4 there is illustrated yet another easy opening panel configuration. The arrangement of FIG. 4 includes a container panel 70 which normally will be an end panel of an end unit, such as the end unit 11. The end unit 70 has defined therein by a combination of cut and score lines a removable panel portion which, when displaced from the plane of the end panel 70, will define a dispensing opening.

Most specifically, adjacent the periphery of the end panel 70 is a transverse cut line 71 which terminates at its upper ends in apertures 72. Extending from each aperture 72 is a score line 73 in the form of a line of weakness along which the end panel 70 may be ruptured to effect opening of the container of which it is a part. Each score line 73 of the respective aperture 72 includes a longitudinally and transversely outwardly sloping portion 74 which is connected to a longitudinally extending and transversely sloping portion 75 by an intermediate arcuate portion 76. Each score line 73 also includes a straight line longitudinally extending portion 77 which is connected to the respective portion 75 by an arcuate portion 78. The free ends of the score line 73 terminate remote from the apertures 72 in an outwardly directed curving portion 80 wherein the free ends of the score lines 73 face in remote directions.

It will be seen that the cut line 71 together with the apertures 72 and the score lines 73 define a removable panel portion 81 which includes a connecting strap 82 disposed remote from the cut line 71. When the end panel 70 is ruptured along the score line 73 and the removable panel portion 81 is folded upwardly and to the right, a suitable dispensing opening 83 will be defined in the end panel 70. In order to effect the displacement of the removable panel portion 81 and the folding of the strap portion 82. There is provided a pull tape 84 which corresponds generally to the pull tape 22 and includes an elongated rectangular portion 85 which directly overlies the removable panel portion 81 and is suitably bonded to the end panel 70. The pull tape portion 85 has a terminal end 86 remote from the cut line 71. A permanent bond 87 is formed between the pull tape 84 adjacent its end 86 with the permanent bond 87 extending over a generally rectangular area. A further permanent bond 88 is formed between the removable panel portion 81 and the pull tape 84. Finally, a peelable bond 90 is formed between the pull tape 84 and the end panel 70 surrounding the removable panel portion 81 and the strap portion 82. It is to be noted that the peelable bond extends entirely to the permanent bond 87 and that the free ends of the score line 73 terminate immediately adjacent the permanent bond 87.

It is to be understood that, as described with respect to FIG. 1, the pull tape 84 first of all serves to prevent venting of the interior of an associated container along the cut lines 71 and through the apertures 72. Secondly, it applies a downward force on the removable panel portion 81 so as to prevent the accidental rupture of the score lines 73. Next, through its permanent bond 88 with the removable panel portion 81, further upward movement of the pull tape to the right will result in the rupture of the score lines 73 to permit the removable panel portion 81 to be displaced from the end panel 70. Further pulling on the pull tape 84 will result in the tearing of the score line portions 77 so that the removable panel portion 81 may be folded back to an out of the way position but while still connected to the end panel 70 by the connecting strap portion 82 and, of course, by the permanent bond 88 to the pull tape 84.

A further feature of the easy opening construction of FIG. 4 is the formation in the end panel 70 of several openings, most specifically the openings 91 and 92. The opening 91 is the larger of the two openings and is aligned with the widest portion of the removable panel portion 81. The opening 92 is, of course, in a narrower portion of the removable panel portion 81. The openings 91 and 92 are configurated so as not to unduly affect a removal of material to weaken the removable panel portion 81.

The openings 91, 92 have the beneficial effect of reducing the area of the removable panel portion 81 against which the internal pressure within an associated container may act. This, in turn, reduces the total rupture tending forces on the removable panel portion. On the other hand, the pull tape 84 being permanently bonded to the removable panel portion 81 by the permanent bond 88 receives that force and transmits it through the peelable bond 90 to the end panel 70. Thus, the simple provision of suitable openings in the removable panel portion provides for a stronger container construction and the permissible deeper scoring of the end panel 70 along the score line 73.

Figure 5:
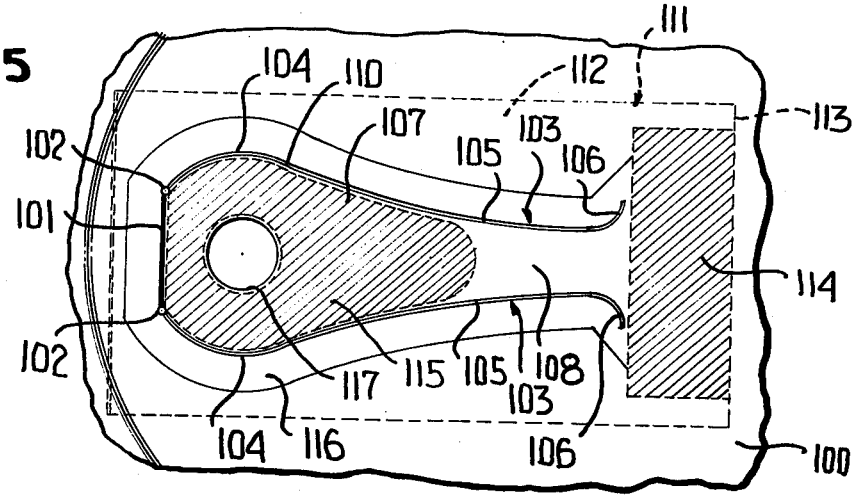
FIG. 5 is a schematic plan view of a modification of the removable panel portion of FIG. 4, and shows also a modified bond arrangement.

Reference is now made to FIG. 5 wherein a modification of the easy opening arrangement of FIG. 4 is illustrated. The easy opening arrangement is formed in a container panel 100 which is preferably in the form of an end panel of an end unit such as the end unit 11 of FIG. 7.

Disposed adjacent the periphery of the end panel 100 is a cut line 101 which terminates at its opposite ends in a pair of apertures 102. Extending longitudinally from each aperture 102 is a score line 103. Each score line 103 includes an outwardly projecting arcuate portion 104 starting at the respective aperture 102 and terminating in an inwardly sloping longitudinally extending outwardly opening arcuate portion 105. Each arcuate portion 105 terminates in a curved terminal portion 106 with the free ends of the score lines 103 facing in opposite directions. The cut line 101, which extends transversely relative to the score lines 103, in conjunction with the apertures 102, the score line portions 104 and parts of the score line portions 105, define a removable panel portion 107 which is displaceable out of the general plane of the end panel 100. The remainder of each of the score line portions 105 define a connecting strap portion 108 which is an integral extension of the removable panel portion 107. The removable panel portion 107, when displaced from the end panel 100, defines a dispensing opening 110 having that end thereof adjacent the periphery of the end panel 100 defined by the cut line 101.

In accordance with this invention there is also provided a pull tape, generally identified by the numeral 111. The put tape is of the same construction as the pull tape 22 and only that portion thereof which directly overlies the end panel 100 is illustrated. That portion is identified by the numeral 112. The free end of the pull tape 112 remote from the cut line 101 is identified by the numeral 113 and that portion of the pull tape 111 adjacent the free end 113 is permanently bonded to the end panel 100 by means of a permanent bond 114 which is generally rectangular in outline. The permanent bond 114 is disposed closely adjacent to but spaced from the curved score line portions 106.

The pull tape 111, which completely overlies and extends beyond the removable panel portion 107, is secured to the removable panel portion by a second permanent bond 115. It is to be noted that the permanent bond 115 does not extend the full length of the connecting strap portion 108, but is generally limited to the removable panel portion 107.

The pull tape 111 is further bonded to the end panel 100 by way of a peelable bond 116 which extends about the removable panel portion 107 and the connecting strap portion 108 and terminates at the permanent bond 114.

It will be readily apparent that when the pull tape 111 is lifted away from the plane of the end panel 100 and moved to the right, peeling of the peelable portion 116 will be initiated until the cut line 101 is reached, at which time further lifting of the pull tape will be retarded by the permanent bond 115. However, as the pull tape 111 is continued to be lifted and pulled back through the permanent bond 115, the material of the end panel along the score lines 103 will be stressed and ruptured so that opening may be effected.

It is to be noted that the widest portion thereof the removable panel portion has a through opening 117 which is in the form of an area reducing opening whereby reducing the area of the removable panel portion 107 is effected by internal pressure within the container of which the end panel 100 is a part. The pull tape 111 will seal closed the opening 117 and will transfer the pressure exerted force to the peelable bond 116, thereby reducing the rupture force applied on the removable panel portion 105 by gaseous pressure within the container.

Figure 6:
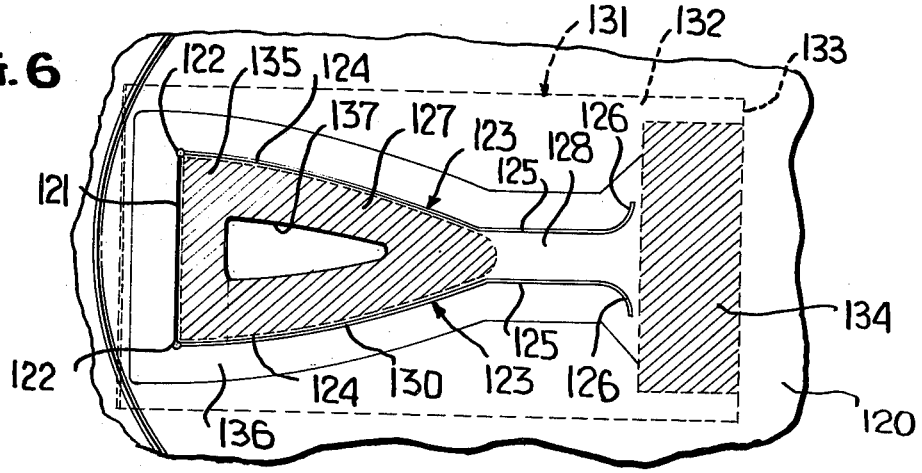
FIG. 6 is a schematic plan view similar to FIG. 4, and shows still another modified removable panel portion arrangement and bond arrangement.

Referring now to FIG. 6, it will be seen that there is illustrated yet another form of easy opening container construction. Once again, there is a container panel which is identified by the numeral 120 and preferably is in the form of an end panel of an end unit, such as the end unit 11 of FIG. 7. The container panel 120 has a combination cut line and score line easy opening configuration.

Most particularly, adjacent the periphery of the end panel 120 is a cut line 121 which terminates at its opposite ends in apertures 122. A score line, generally identified by the numeral 123, extends to the right from each aperture 122. Each score line 123 includes a convex arcuate portion 124 which extends from the respective aperture 122 to its intersection with a straight line portion 125. The straight line portions 125 terminate in terminal curved portions 126 which extend in opposite directions so that free ends of the score lines 123 remote from the cut line 121 face in opposite directions.

It will be seen that the score lines 123 extend generally longitudinally while the cut line 121 extends transversely. The cut line 121, together with the apertures 122 and the score line portions 124, define a removable panel portion 127 which is displaceable from the plane of the end panel 120. On the other hand, the straight line score line portions 125 define a connecting strap portion 128 which is integral with the removable panel portion 127 and permits hinging of the removable panel portion 127 to an out of the way position while still remaining attached to the end panel 120. The removable panel portion 127 defines a dispensing opening 130 when it is displaced from the end panel 120 with that end of the dispensing opening 130 defined by the cut line 121 being the primary pour portion and the opposite end being a vent portion.

In accordance with this invention, there is also provided a pull tape generally identified by the numeral 131. The pull tape 131 corresponds to the pull tape 22 and is of a like construction. Only an elongated rectangular portion 132 of the pull tape 131 is illustrated. It is to be noted that the pull tape 131 is generally aligned with and overlies the easy opening configuration of the end panel 120.

The pull tape portion 132 has a terminal end 133 remote from the cut line 121 and immediately adjacent the terminal end of the pull tape 131 has a permanent bond 134 with the end panel 120. The permanent bond 134 extends over a generally rectangular area which terminates immediately adjacent but spaced from the free ends of the score lines 123.

The pull tape 131 also has a permanent bond 135 with the removable panel portion 127. Thus, the removable panel portion 127 remains adhered to the pull tape 131 under all conditions.

Finally, there is a peelable bond 136 between the pull tape 131 and the end panel 120 completely surrounding both the removable panel portion 127 and the connecting strap 128. The peelable bond extends to the permanent bond 134.

It will be apparent that the pull tape 131 seals the end panel 120 along the cut line 121 and the apertures 122. Further, the peelable bond 136 serves to hold the removable panel portion 127 in place and aids in the resisting of the rupture of the end panel 120 along the score lines 123.

When the opening of the end panel 120 is desired, the pull tape 131 is pulled upwardly and to the right, initiating peeling of the peelable bond 136. As peeling continues, the pull tape exerts an upwardly directed force on the removable panel portion 127 and causes a progressive rupture of the score lines 123 starting at the apertures 122. It will be apparent that the removable panel portion 127 remains bonded to the pull tape and thus remains connected to the end panel 120 both through the connecting strap portion 128 and the pull tape 131.

In order to reduce the force exerted on the removable panel portion 127 by gaseous pressures within a container of which the end panel 120 is a part, a force reducing opening 137 is formed through the interior portion of the removable panel portion 127. The opening 137 has a general outline corresponding to that of the removable panel portion. The opening 137 is sealed by the pull tape 132 and the pressure exerting force on the pull tape is transferred to the peelable bond 136.

Returning now to FIG. 1, it will be seen that if desired a suitable force reducing opening 140 may be formed in the removable panel portion 120. In a like manner, one or more force reducing openings 141, 142 may be formed in the removable panel portion 38 in FIG. 2 in the same manner as are the openings 91, 92 formed in the removable panel portion 81 in FIG. 4. Finally, an elongated force reducing opening 143 may be formed in the removable panel portion 56 of FIG. 3 with the opening 143 corresponding to the opening 137.

Although a number of preferred embodiments of the easy opening configuration have been specifically illustrated and described, it is to be understood that further modifications may be made in the easy opening configurations without departing from the spirit and scope of the invention as defined by the appended claims.

I claim:

1. An easy opening container arrangement comprising a container panel, a removable panel portion defined in said container panel by the combination of at least one cut line and at least one score line, said cut line defining an initially opening part of said removable panel portion, a pull tape overlying a part of said container panel including said removable panel portion, said pull tape having a peelable bond with said container panel surrounding said removable panel portion and a permanent bond with said removable panel portion, said pull tape further having a permanent bond with said container panel adjacent said removable panel portion and remote from said cut line.

2. The container arrangement of claim 1 wherein said pull tape is longitudinally elongated and said cut line extends transversely of said pull tape.

3. The container arrangement of claim 1 wherein said container panel is an end panel of generally circular outline and said cut line is disposed adjacent the periphery of said end panel.

4. The container arrangement of claim 1 wherein said cut line intersects said at least one score line in an aperture.

5. The container arrangement of claim 2 wherein said cut line terminates at the opposite ends thereof in apertures, and a score line portion extends from each aperture.

6. The container arrangement of claim 5 wherein there is a single score line of a generally U-shaped outline.

7. The container arrangement of claim 5 wherein there are two separate score lines, each terminating in a terminal end adjacent said permanent bond between said pull tape and said container panel.

8. The container arrangement of claim 5 wherein said cut line is a substantially straight line.

9. The container arrangement of claim 5 wherein said cut line defines the widest part of said removable panel portion.

10. The container arrangement of claim 5 wherein said cut line defines the widest part of said removable panel portion, and said score line is a single line including plural straight line portions joined by a terminal arcuate portion.

11. The container arrangement of claim 5 wherein said cut line defines the widest part of said removable panel portion, and said score line is a single line including two curved side portions joined by a terminal arcuate portion.

12. The container arrangement of claim 5 wherein said removable panel portion increases in width from said cut line and then gradually decreases in width.

13. The container arrangement of claim 7 wherein said score lines diverge away from said permanent bond between said pull tape and said container panel.

14. The container arrangement of claim 1 wherein there is at least one force reducing opening through said removable panel portion, said force reducing opening being sealed by said pull tape.

15. The container arrangement of claim 14 wherein said removable panel portion increases in width from said cut line to a part of maximum width and then decreases in width, and said force reducing opening is generally centered in said part of maximum width.

16. The container arrangement of claim 14 wherein said removable panel portion increases in width from said cut line to a part of maximum width and then decreases in width, and one force reducing opening is generally centered in said part of maximum width, and a second force reducing opening is in said part of decreasing width.

17. The container arrangement of claim 14 wherein said force reducing opening is elongated and is of a general shape corresponding to the outline of an adjacent portion of said removable panel portion.

18. The container arrangement of claim 14 wherein there are two separate score lines, each terminating in a terminal end adjacent said permanent bond between said pull tape and said container panel.

19. An easy opening container arrangement comprising a container panel, a removable panel portion defined in said container panel by the combination of at least one cut line and at least one score line, said cut line defining an initially opening part of said removable panel portion, a pull tape overlying a part of said container panel including said removable panel portion, said pull tape having a peelable bond with said container panel surrounding said removable panel portion and a permanent bond with said removable panel portion, at least one force reducing opening through said removable panel portion, said force reducing opening being sealed by said pull tape.

20. The container arrangement of claim 19 wherein said removable panel portion increases in width from said cut line to a part of maximum width and then decreases in width, and said force reducing opening is generally centered in said part of maximum width.

21. The container arrangement of claim 19 wherein said removable panel portion increases in width from said cut line to a part of maximum width and then decreases in width, and one force reducing opening is generally centered in said part of maximum width, and a second force reducing opening is in said part of decreasing width.

22. The container arrangement of claim 19 wherein said cut line defines the widest part of said removable panel portion.

23. An easy opening container arrangement comprising a container panel, means in said container panel defining a removable panel portion, a pull tape overlying a part of said container panel including said removable panel portion, said pull tape having a peelable bond with said container panel surrounding said removable panel portion and a permanent bond with said removable panel portion, at least one force reducing opening through said removable panel portion, said force reducing opening being sealed by said tear tape.

24. The container arrangement of claim 23 wherein said removable panel portion is defined at one end by a starting cut line and along each side by a score line including an outwardly bowed starting portion and a narrowing trailing portion.

25. The container arrangement of claim 24 wherein each score line is first convexly bowed and then concavely bowed.

* * * * *